US006158735A

United States Patent [19]

Cote et al.

[11] Patent Number: 6,158,735

[45] Date of Patent: Dec. 12, 2000

[54] APPARATUS AND METHOD FOR SPLITTING A STREAM OF SIGNATURES INTO A FIRST AND SECOND SUBSTREAM OF SIGNATURES

[75] Inventors: Kevin Lauren Cote, Durham; Richard Daniel Curley, Dover; David Clarke Pollock, Somersworth, all of N.H.

[73] Assignee: Heidelberger Druckmaschinen AG, Heidelberg, Germany

[21] Appl. No.: 09/020,644

[22] Filed: Feb. 9, 1998

[51] Int. Cl.[7] ..... B65H 39/10

[52] U.S. Cl. ..... 271/302; 271/280; 271/285; 271/286; 271/225; 271/184; 198/440; 198/441; 198/418.8; 198/457

[58] Field of Search ..... 198/440, 441, 198/418.8; 271/280, 285, 286, 225, 184

[56] References Cited

U.S. PATENT DOCUMENTS

| | | | |
|---|---|---|---|
| 2,254,290 | 9/1941 | Joa | 198/440 |
| 4,477,066 | 10/1984 | Fischer et al. . | |
| 4,572,350 | 2/1986 | Besemann | 198/372 |
| 4,986,730 | 1/1991 | Wetter | 198/457 X |
| 5,048,818 | 9/1991 | Nemeskal | 271/283 |
| 5,112,041 | 5/1992 | Honegger | 271/286 |
| 5,433,430 | 7/1995 | Straessler et al. | 271/280 |
| 5,597,156 | 1/1997 | Claassen | 271/280 |
| 5,833,226 | 11/1998 | Claassen | 270/52.16 |

FOREIGN PATENT DOCUMENTS

| | | | |
|---|---|---|---|
| 0578614A1 | 1/1994 | European Pat. Off. | 271/302 |
| 24 17 614 | 10/1975 | Germany . | |
| 667 858 | 11/1988 | Switzerland . | |
| 677-480 | 5/1991 | Switzerland | 271/184 |
| 94/13566 | 6/1994 | WIPO . | |
| 94/13567 | 6/1994 | WIPO . | |

*Primary Examiner*—Jospeh E. Valenza
*Assistant Examiner*—Richard Ridley
*Attorney, Agent, or Firm*—Kenyon & Kenyon

[57] ABSTRACT

A stream of signatures is delivered by a conveyer belt to an angled conveyer. The angled conveyor grips a set of signatures from the stream. The gripped set of signatures is transported by the angled conveyer to a third conveyer belt, and deposited on the third conveyer belt. By transporting the set of signatures at an angle, a lateral offset between the individual signatures within the set of signatures is created. A diverter on the third conveyer belt grips the laterally offset signatures, separating the signatures into substreams.

14 Claims, 3 Drawing Sheets

APPARATUS AND METHOD FOR SPLITTING A STREAM OF SIGNATURES INTO A FIRST AND SECOND SUBSTREAM OF SIGNATURES

FIELD OF THE INVENTION

The present invention relates generally to a delivery systems for signatures printed by a printing press, and more particularly to a device and method for diverting signatures.

RELATED TECHNOLOGY

Signature diverting devices are known, for example, which use grippers to grasp a stream of signatures exiting a folder and then split alternating signatures to form two separate streams. However, the use of grippers to split a steam requires a mechanism which is costly and complicated.

Bump turns which rely on the weight of signatures and belts to change the transportation direction of signatures from "fold to the side" to "fold leading" are also known. However conventional bump turns cannot be used to split a single stream of signatures into two streams.

SUMMARY OF THE INVENTION

The present invention provides a signature diverting device for splitting a main stream of signatures into a first substream and a second substream. The signature diverging device comprises: (1) an angled transporter for transporting at least a pair of signatures from the main stream at an angle to the main stream in an angled transport direction, (2) a further conveying device for conveying the pair of signatures in a further conveying direction different from the angled transport direction as the pair of signatures exit the angled transporter, so that a lateral offset is created between a first and a second signature of the pair of signatures, and (3) a diverter for contacting the first signature after the lateral offset has been created and diverting the first signature into the first substream.

The present invention also provides a method for diverting a main stream of signatures having a first orientation into at least two substreams. The method comprises the steps of: (1) transporting at least a pair of signatures in an angled transport direction which is angled from the main stream, the pair of signatures retaining the first orientation in the angled transport direction; (2) further conveying the pair of signatures in a further conveying direction different from the angled transport direction; and (3) splitting the pair of signatures to form a first substream and a second substream.

The present invention therefore accomplishes a signature diversion without the use of complicated mechanical devices and without depending on the weight of the signatures.

DETAILED DESCRIPTION

Figure 1:
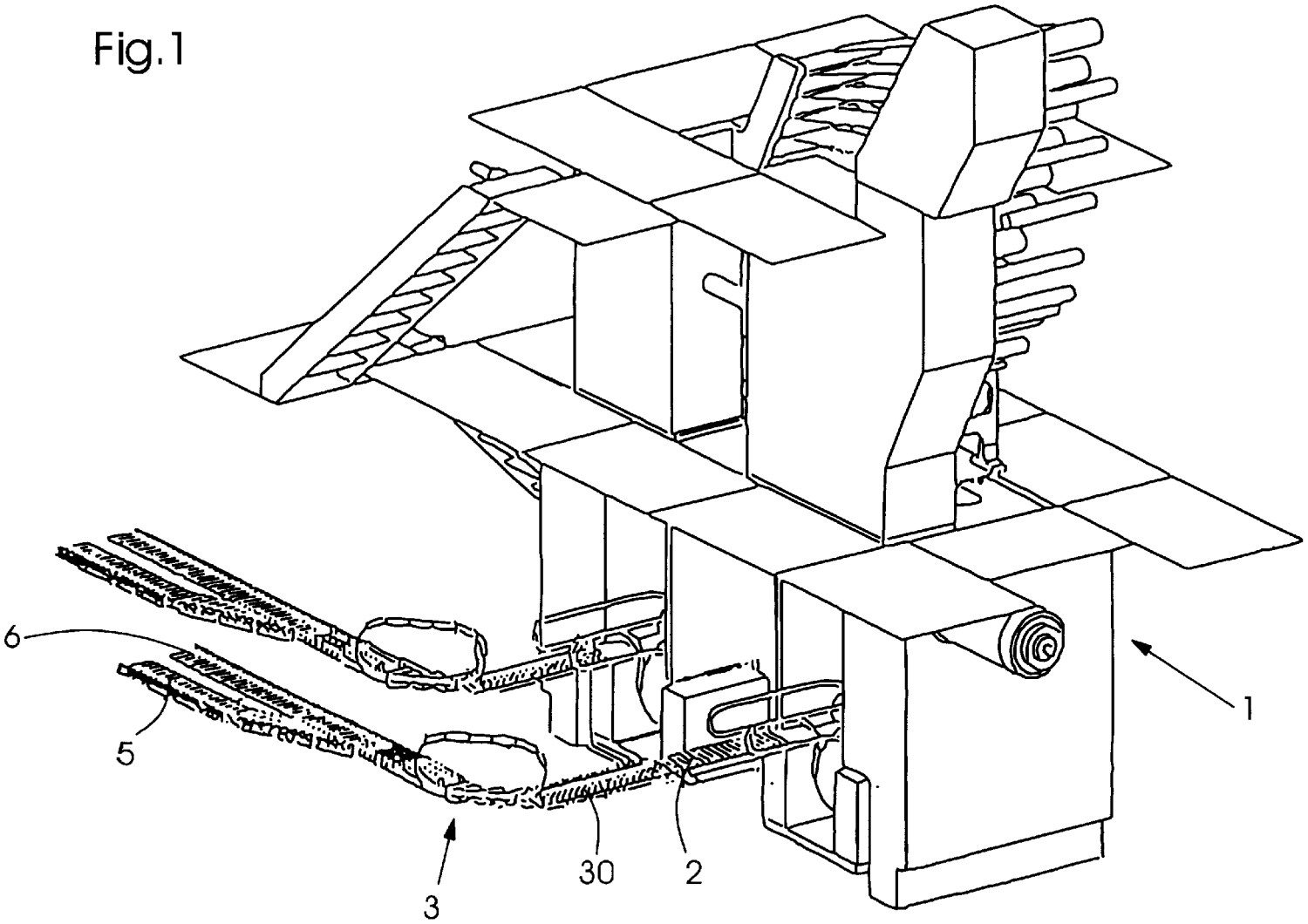
FIG. 1 shows a folding machine with a stream of signatures exiting the folding machine and being diverted by the diverting device of the present invention.

FIG. 1 shows a folding machine 1 delivering signatures 2 in a main stream 30. The signatures 2 in main stream 30 are in a shingled, fold-to-the-side configuration, comprised of alternate "A" and "B" signatures. The signatures 2 in the main stream 30 are then delivered through an angled transport region 3. After they exit the angled transport region 3 they are then diverted into two separate substreams where one substream 5 contains the A signatures and one substream 6 contains the B signatures.

Figure 2:
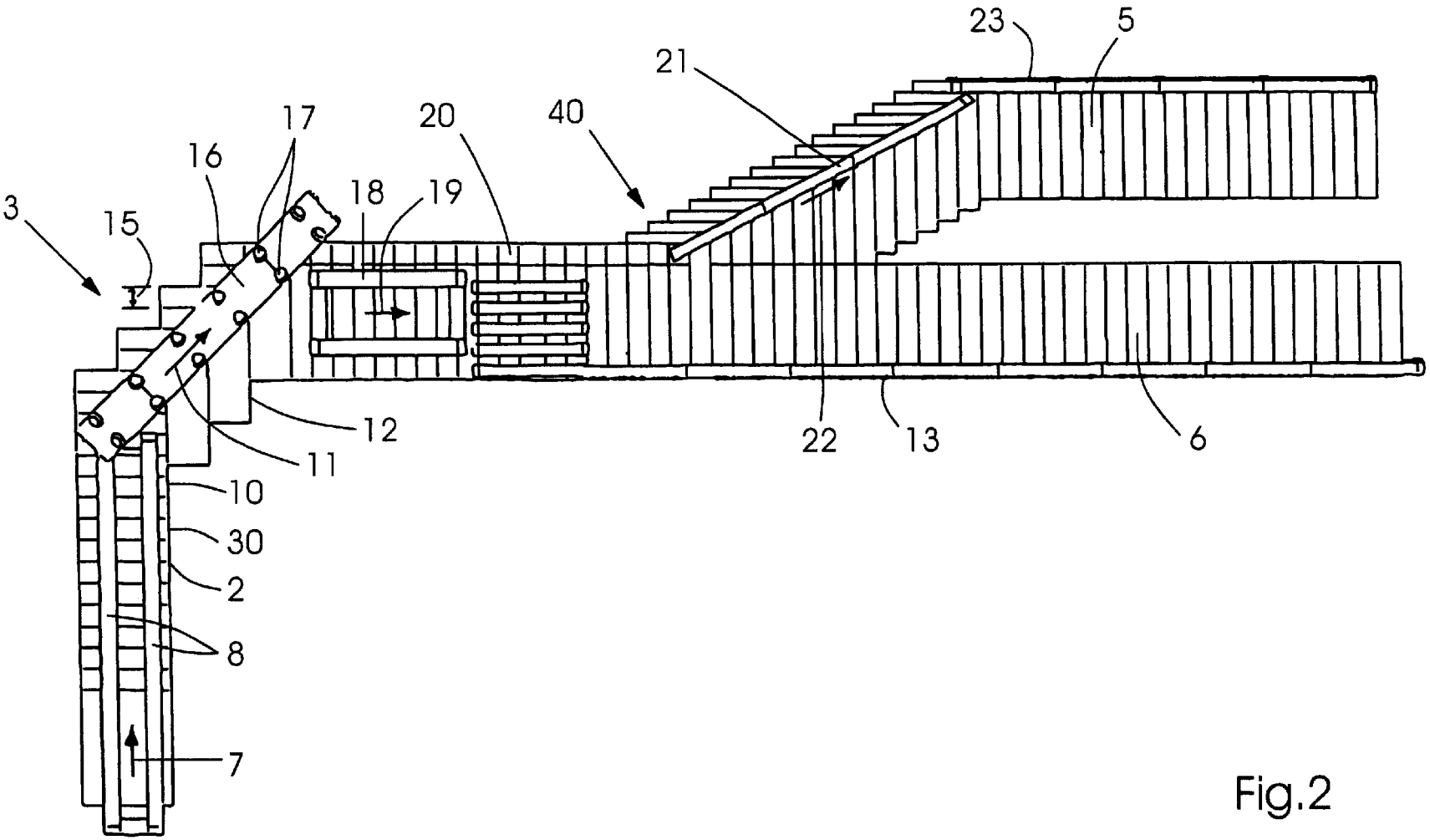
FIG. 2 shows a top view of the diverting device of the present invention with a first embodiment of the angled transporter.

FIG. 2 shows in more detail the signature delivery device of the present invention. Signatures 2 are transported in the main stream 30 in a fold-to-the-side orientation by transport belts 8 in a first direction 7. Folded edges 10 of the signatures 2 are in line with one another in this region.

As the signatures 2 reach the angled transport region 3, a pair 12 of the signatures comprising one A signature and one B signature is contacted from above by lugs 17 on an upper transport belt 16. One lug 17 contacts the A signature and one lug 17 the B signature. The lugs 17 are preferably made of rubber. The pair of signatures is thus nipped from above by the lugs 17 on the upper transport belt 16 and from below by a lower transport belt (not shown), which is preferably flat. The transport belts are angled, preferably at 45 degrees, so that the pair 12 of signatures travel in an angled direction 11 within the angled transport region 3. The folded edges 10 of the signature pair 12 remain parallel to the first direction 7 while in the angled transport region 3. The signatures 2 thus retain their original orientation in the angled transport region 3, even though they travel at an angle.

As the signature pair 12 exits the angled transport region 3, the fold edges 10 of the signature pair 12 contact a pair of upper transport belts 18 which run in a further direction 19. The signatures 2 are then traveling in the direction 19. The fold edges 10 are leading on both the "A" and "B" signatures, with the "A" signatures 20 offset laterally from the "B" signatures. If the direction 19 is at 90 degrees from the direction 7, which is preferable, the size of the offset is equivalent to the pitch between the signatures, which is indicated by the number 15. The offset allows a diverter belt 21 to contact the "A" signatures and not the "B" signatures as the shingled stream passes by a diverter station 40. The "A" signatures are pulled out of the shingled stream in a diversion direction 22. The "B" signatures continue to be fed in the direction 19 by belt 13.

The "A" signatures change direction again when they contact belt 23. The signatures are thus separated into two independent fold-leading shingled substreams 5 and 6.

Figure 3:
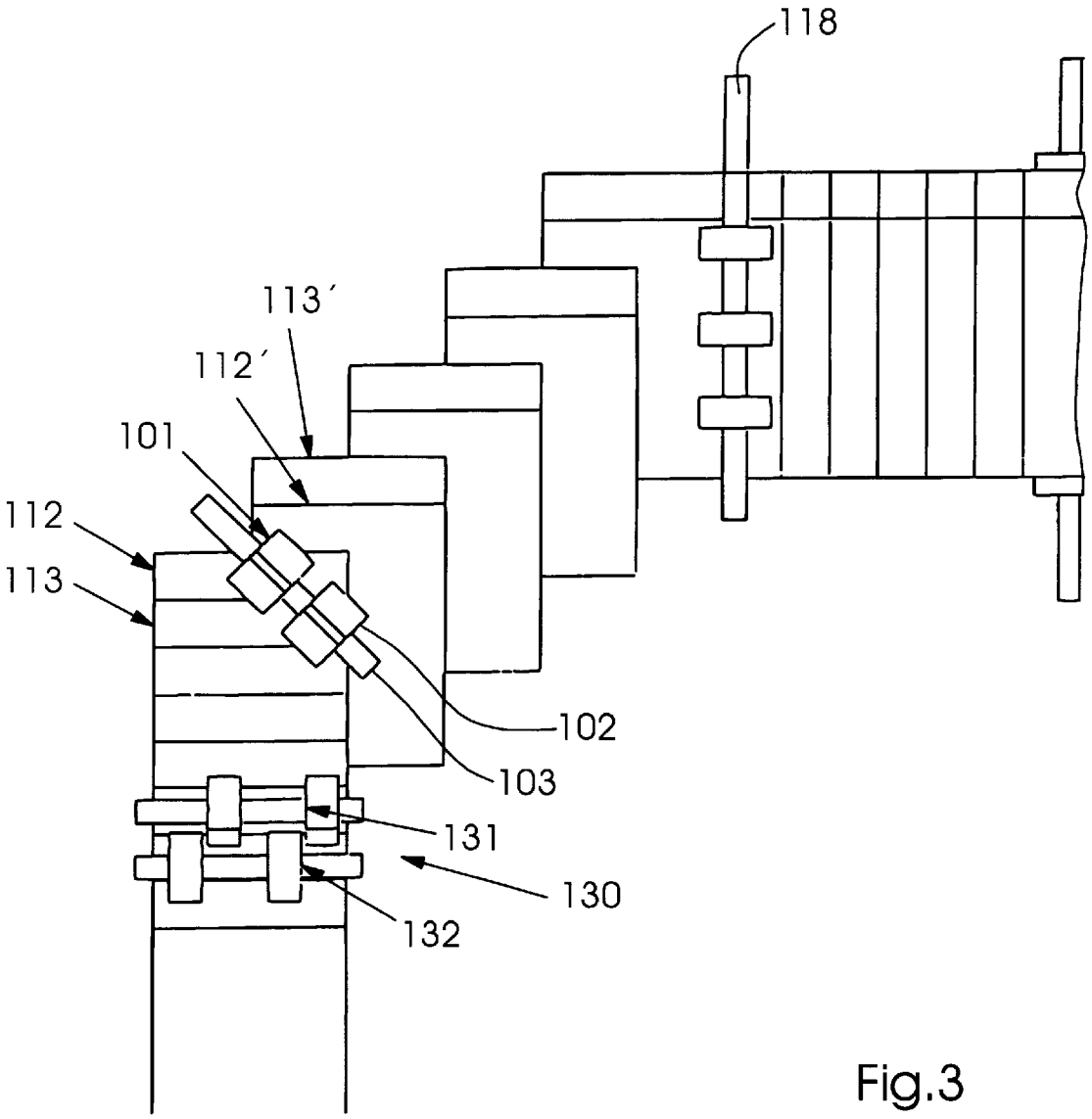
FIG. 3 shows an alternate embodiment of the angled transporter of the present invention.

FIG. 3 shows an alternate embodiment of the angled transporter, in which a pulley system is used to transport a pair of sheet in the angled direction. A first signature 112 and a second signature 113 are gripped from above by pulleys or cylindrical members 101 and 102 located on an axle 103, which have raised sections on an outside diameter to nip the signatures 112, 113 against a belt or other device with a new angled direction. The signatures 112 and 113 are then passed onto another set of pulleys (not shown) above signatures 112' and 113'. Thus a plurality of pulleys pass the signatures on until they reach a further conveying device 118.

Advantageously, the angled transport device may include a retainer 130 which only releases the sheets as they are ready to be transported in the angled direction. The retainer 130 thus prevent static electricity or friction from inadvertently carrying more sheets along in the angled direction than desired. The retainer includes a first set of nip wheels 131 and a second set of nip wheels 132 which can nip the sheets against a belt or other nip device. The wheels 131 have raised sections and are timed so that the pressure in the nip is released just as the signature 112 begins to be transported in the angled direction. The wheels 131 also relieve pressure from signature 113, as this is above signature 112. The wheels 132 may either be fully circular on the outside diameter, in which case they are positioned to release signature 113 just as signature 113 is to be transported in the angled direction, or can also have raised sections and timed for release of signature 113 as wheels 131 are for signature 112. It should be understood that the angled transport device of FIG. 2 could also include a retainer.

It should be understood that the angled transporter could also be designed to transport the signatures in sets of three or more. If a set of three were used, an additional diverter would be used so that the main stream is split into three streams.

What is claimed is:

1. A signature diverting device for splitting a main stream of signatures into at least a first substream and a second substream, the signature diverting device comprising:

a first conveying device for conveying a single stream of shingled signatures in a first direction;

an angled second transporter which grips a set of signatures including at least a first and a second signature from the shingled single stream and transports the set of signatures from the main stream at an angle to the main stream in an angled second transport direction;

a further third conveying device for conveying the set of signatures in a further third conveying direction different from the angled second transport direction, thereby maintaining an offset substantially lateral to the third conveying direction between a first and a second signature of the set of signatures; and a diverter for contacting the first signature after the lateral offset has been created and diverting the first signature into the first substream, whereas the second signature is fed continuously into the third conveying direction thereby creating the second substream.

2. The signature diverting device as recited in claim 1 wherein the angled transporter includes an upper transport belt and a lower transport belt.

3. The signature diverting device as recited in claim 2 wherein the upper transport belt has lugs.

4. The signature diverting device as recited in claim 1 wherein the angled transporter includes at least one pulley.

5. The signature diverting device as recited in claim 1 wherein the angled transporter includes a plurality of pairs of pulleys, each pair of pulleys being rotatably mounted on an axle.

6. The signature diverting device as recited in claim 1 wherein the angled transport direction is at a 45 degree angle to the main stream.

7. The signature diverting device as recited in claim 1 wherein the further conveying direction is at a 90 degree angle to the main stream.

8. The signature diverting device as recited in claim 1 wherein the angled transporter transports the signatures at an angle in groups of two.

9. The signature diverting device as recited in claim 1 wherein the angled transporter transports the signatures at an angle in groups of three.

10. The signature diverting device as recited in claim 1 wherein the further conveying device includes a transport belt.

11. The signature diverting device as recited in claim 1 wherein the diverter includes a transport belt.

12. The signature diverting device as recited in claim 1 wherein the signatures in the main stream are fold-to-the-side.

13. The signature diverting device as recited in claim 1 wherein the signatures in the substreams are fold leading.

14. The signature diverting device as recited in claim 1 wherein the angled transporter includes a retainer.

* * * * *